US010030946B2

(12) United States Patent
Marietta

(10) Patent No.: US 10,030,946 B2
(45) **Date of Patent: *Jul. 24, 2018**

(54) FIREWORKS AERIAL DISPLAY SHELL AND METHOD OF USE

(71) Applicant: Jake's Fireworks Inc., Pittsburgh, KS (US)

(72) Inventor: Michael Marietta, Wichita, KS (US)

(73) Assignee: Jake's Fireworks Inc., Pittsburg, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/860,372

(22) Filed: Jan. 2, 2018

(65) Prior Publication Data

US 2018/0120067 A1 May 3, 2018

Related U.S. Application Data

(63) Continuation of application No. 15/360,374, filed on Nov. 23, 2016, now Pat. No. 9,885,549, which is a continuation-in-part of application No. 15/015,922, filed on Feb. 4, 2016, now Pat. No. 9,506,730.

(51) Int. Cl.

| | |
|---|---|
| ***F42B 4/14*** | (2006.01) |
| ***F42B 4/02*** | (2006.01) |
| ***F42B 4/24*** | (2006.01) |
| ***F42B 4/22*** | (2006.01) |

(52) U.S. Cl.
CPC ..... *F42B 4/02* (2013.01); *F42B 4/22* (2013.01); *F42B 4/24* (2013.01)

(58) Field of Classification Search
USPC ..... 102/352, 360, 346, 347, 335, 350, 356; 86/20.1
See application file for complete search history.

(56) References Cited

U.S. PATENT DOCUMENTS

| | | | | |
|---|---|---|---|---|
| 6,283,033 | B1 * | 9/2001 | Wu | F42B 4/14 102/336 |
| 6,543,362 | B1 * | 4/2003 | Muskat | F41A 19/58 102/202 |
| 6,912,958 | B2 * | 7/2005 | Marietta | F42B 4/02 102/346 |
| 9,506,730 | B1 * | 11/2016 | Marietta | F42B 4/14 |

* cited by examiner

*Primary Examiner* — John W Eldred
(74) *Attorney, Agent, or Firm* — Hovey Williams LLP

(57) ABSTRACT

A fireworks aerial display shell is provided with lift charges positioned at opposite ends of a casing that additionally contains an effects charge. Fuses are operatively associated with the lift charges and the effects charge in a manner to ignite the lift charges a period of time before igniting the effects charge. When either one of the ends of the casing is placed facing a closed bottom of a launch tube of a reusable mortar, the burning lift charge at that end of the casing when ignited exerts a propelling force to propel the aerial display shell upwardly out of the launch tube to an intended height before the effects charge is ignited to create a pyrotechnic visual effects display.

20 Claims, 3 Drawing Sheets

FIREWORKS AERIAL DISPLAY SHELL AND METHOD OF USE

RELATED APPLICATIONS

This application is a continuation of U.S. application Ser. No. 15/360,374 filed Nov. 23, 2016, which claims priority to U.S. application Ser. No. 15/015,922, filed Feb. 4, 2016, now U.S. Pat. No. 9,506,730, with the above-identified applications incorporated by reference herein in their entireties.

BACKGROUND OF THE INVENTION

The present invention relates generally to fireworks and, more particularly, to a fireworks aerial display shell, such as a consumer fireworks aerial display shell, of the type intended to be launched from a launch tube of a mortar and to a method of launching the aerial display shell to a desired altitude where it breaks or bursts to create a pyrotechnic, visual effects display.

As used herein, "consumer fireworks" has the meaning set forth in Title 27, Code of Federal Regulations, Section 55.11, as small fireworks devices designed to produce visible effects by combustion and which comply with the construction, chemical composition, and other requirements of the U.S. Consumer Product Safety Commission, as set forth in Title 16, Code of Federal Regulations, parts 1500 and 1507.

Consumer fireworks aerial display shells of the type intended to be placed within and then launched from a launch tube of a mortar are well known and are commonly referred to as reloadables. An example of one such aerial display shell is disclosed in U.S. Pat. No. 6,912,958. The aerial display shell disclosed in that patent has a cylindrical casing and a long lead fuse, commonly referred to as a shell leader, that ignites a lift charge housed at one end of the casing. When ignited, the lift charge propels the aerial display shell upwardly and out of the launch tube. The aerial display shell includes an effects charge, comprised of stars and a burst charge, which is separated from the lift charge in the casing and produces the pyrotechnic visual effects display. The effects charge is ignited by a timing or delay fuse. The timing fuse is ignited by the burning lift charge and burns while the aerial display shell is being propelled through the length of the launch tube and during its upward ballistic travel outside the launch tube. The burn time of the timing fuse is set to allow fire to be communicated to the effects charge once the aerial display shell has reached or nearly reached the apex in its ballistic trajectory.

When the aerial display shell described above is properly placed within the mortar, the lift charge is at the bottom of the launch tube and the effects charge is positioned above the lift charge. When oriented in this manner, the hot product gases of the ignited lift charge exert a force against the bottom of the aerial display shell and propel the aerial display shell upwardly out of the launch tube through its open top. It sometimes happens that a user will inadvertently place an aerial display shell within a launch tube in an inverted orientation, with the lift charge positioned above the effects charge. When placed in this orientation, the hot product gases of the burning lift charge do not act upon the aerial display shell to propel it out of the mortar but are instead uselessly vented through the open top of the launch tube. As a result, the aerial display shell remains resting on the closed bottom of the launch tube as the timing fuse continues to burn and then ignites the effects charge while the aerial display shell is inside the launch tube rather than at a safe altitude above the mortar. When the effects charge ignites inside the launch tube, the hot product gases produce an overpressure, which can cause the mortar to rupture. One approach to reducing the potential hazard to users and spectators in the immediate vicinity of the launch tube is to strengthen the launch tube with a reinforcing sleeve that helps the launch tube to withstand the explosive force of the effects charge, such as is disclosed in U.S. Pat. No. 8,807,037.

While the sleeve as disclosed in U.S. Pat. No. 8,807,037 helps to prevent outward rupturing of the tubular wall of the launch tube, the explosive force of the ignited effects charge may still cause the closed bottom or base plug of the launch tube to rupture, making the launch tube unsuitable for reuse. Thus, there remains a need for further improvements that reduce the opportunity for damage to launch tubes and injury to users and spectators when an aerial display shell is loaded in the launch tube in an inverted orientation.

SUMMARY OF THE INVENTION

In one aspect, the present invention is directed to a fireworks aerial display shell comprising a casing having first and second ends and defining an interior volume, a first lift charge positioned in the interior volume of the casing at a location to cause a propelling force to be directed toward the first end of the casing by burning of the first lift charge, a second lift charge positioned in the interior volume of the casing at a location spaced apart from the first lift charge to cause a propelling force to be directed toward the second end of the casing by burning of the second lift charge, an effects charge positioned in the interior volume of the casing between the first lift charge and the second lift charge, and fuses operatively associated with the first and second lift charges and the effects charge in a manner to ignite the first and second lift charges either simultaneously or less than one second apart and then igniting the effects charge a period of time after said igniting of the first and second lift charges. The fuses include a lead fuse operatively connected to the first lift charge in a manner for causing ignition thereof following burning of the lead fuse.

In one embodiment of the aerial display shell, the fuses may also include a connection fuse operatively connecting the first lift charge with the second lift charge to cause the second lift charge to be ignited as a result of ignition of the first lift charge, and a timing fuse operatively connecting the effects charge with either the first lift charge or the second lift charge to cause the effects charge to be subsequently ignited as a result of ignition of the first lift charge or the second lift charge. In order to isolate the effects charge from the first and second lift charges, the aerial shell may include a first partition that extends across an inner cross section of the casing and is positioned between the first lift charge and the effects charge and a second partition that extends across the inner cross section of the casing and is positioned between the second lift charge and the effects charge.

In another aspect, the present invention is directed to a consumer fireworks aerial display shell for launching into the air from within a launch tube. The fireworks aerial display shell comprises a cylindrical casing having first and second ends and defining an interior volume, a first lift charge comprising 5 to 10 grams of pyrotechnics positioned in the interior volume of the casing at a location to cause a propelling force to be directed toward the first end of the casing after the first lift charge is ignited, a second lift charge comprising 5 to 10 grams of pyrotechnics positioned in the interior volume of the casing at a location spaced apart from the first lift charge to cause a propelling force to be directed toward the second end of the casing after the second lift charge is ignited, an effects charge comprising 40 to 50 grams of pyrotechnics positioned in the interior volume of the casing between the first lift charge and the second lift charge, a lead fuse operatively associated with the first lift charge for causing ignition of the first lift charge, a connection fuse operatively associating the first lift charge with the second lift charge to cause ignition of the second lift charge after ignition of the first lift charge, and a delay fuse operatively associating the first lift charge with the effects charge for causing ignition of the effects charge at least 2 seconds after ignition of the first lift charge. Less than a total of 60 grams of pyrotechnics is present in the first and second lift charges, the effects charge, and the lead, connection and delay fuses.

In a further aspect, the present invention is directed to a method of launching a consumer fireworks aerial display shell from within a launch tube and creating a pyrotechnic display. The launch tube has a closed bottom, an open top, and a longitudinal length. The consumer fireworks aerial display shell has a cylindrical casing in which first and second lift charges are positioned at opposite first and second ends of the cylindrical casing and an effects charge is positioned between the first and second lift charges. The method comprising the steps of placing the consumer fireworks aerial display shell in the launch tube with either the first end of the cylindrical casing or the second end of the cylindrical casing facing the closed bottom of the launch tube and the other of the first and second ends of the cylindrical casing facing the open top of the launch tube, igniting a lead fuse to thereby cause ignition of the first lift charge, which causes a first propelling force to be directed toward the first end of the cylindrical casing, igniting the second lift charge as a result of ignition of the lead fuse or the first lift charge to thereby cause a second propelling force to be directed toward the second end of the cylindrical casing. If the consumer fireworks aerial display shell is oriented in the launch tube with the first end of the cylindrical casing facing the closed end of the launch tube, the first propelling force launches the consumer fireworks aerial display shell out of the launch tube and to a first height above the launch tube while the second propelling force is directed to the second end of the cylindrical casing. If the consumer fireworks aerial display shell is oriented in the launch tube with the second end of the cylindrical casing facing the closed end of the launch tube, the second propelling force launches the consumer fireworks aerial display shell out of the launch tube and to a second height above the launch tube while the first propelling force is directed to the second end of the cylindrical casing. The method includes igniting the effects charge to create a pyrotechnic visual effects display a period of time after said launching of the consumer fireworks aerial display shell out of the launch tube.

DETAILED DESCRIPTION

Figure 1:
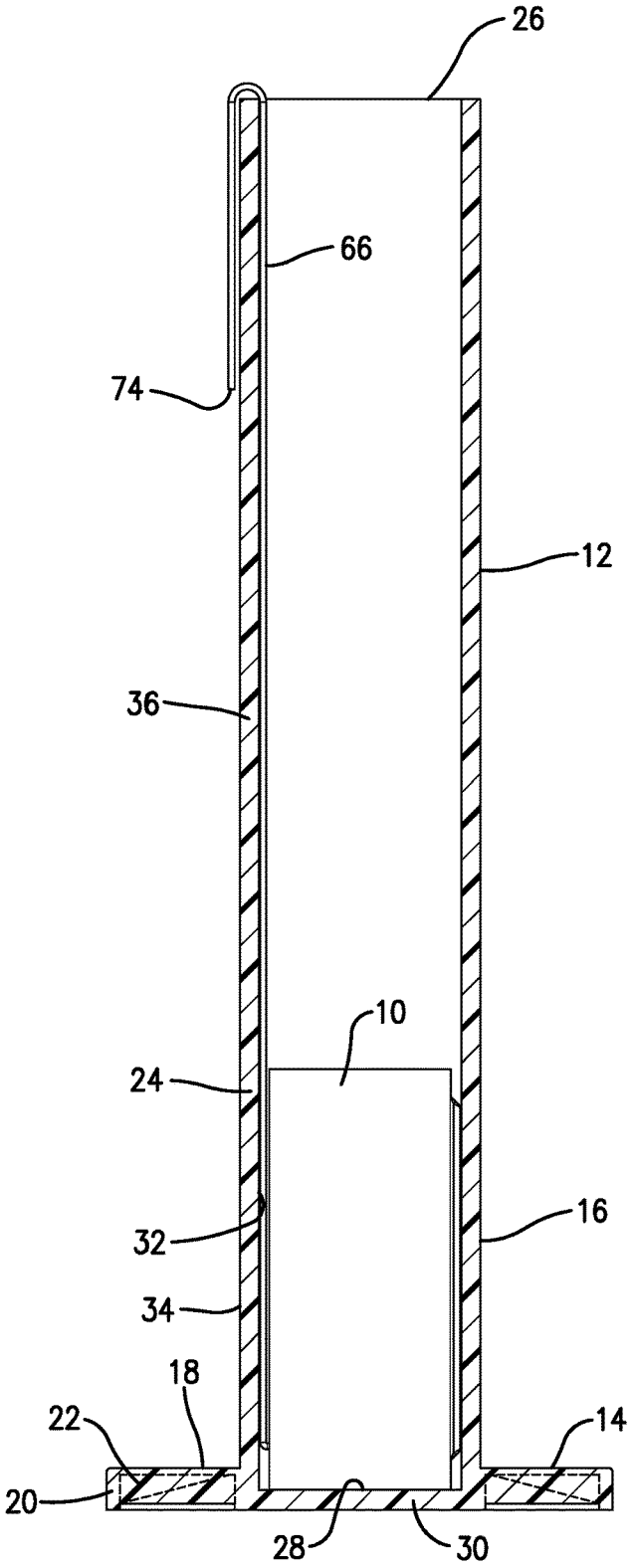
FIG. 1 is a side elevation view of a fireworks aerial display shell loaded into a launch tube of a reuseable mortar, with portions of the mortar removed to show the aerial shell resting on a closed bottom of the launch tube.

Turning now to the drawings in greater detail and initially to FIG. 1, a fireworks aerial display shell 10, which is normally a consumer fireworks aerial display shell, is shown loaded in a reusable mortar 12 of conventional construction. The mortar 12 includes a base 14 that is adapted to rest on the ground or on another stable support surface and an upstanding launch tube 16 that is secured to the base 14.

Figure 2:
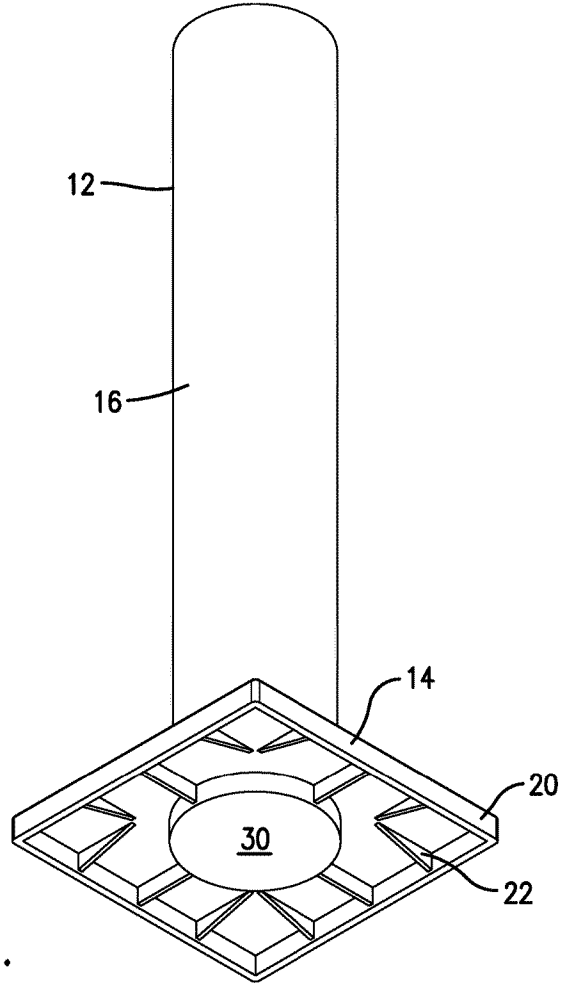
FIG. 2 is a bottom perspective view of the mortar.

The base 14 is of a planar, quadrate configuration, with a top wall 18 and a depending sidewall structure 20. The underside of base 14 is equipped with a series of reinforcing webs 22 as can best be seen in FIG. 2. The launch tube 16 comprises an upstanding hollow tubular wall 24 that presents an open top or muzzle 26 and a closed bottom or base plug 28. The closed bottom 28 may be formed by a circular base 30 that is of an integral, one-piece construction with the tubular wall 24, or it may be formed in other ways, such as by a portion of the base 14. The tubular wall 24 has opposed inner and outer surfaces 32 and 34 that define a wall thickness 36. The lower end of launch tube 16 is centrally located in base 14 with the lowermost surface of base 14 being essentially coincident with the bottom margin of the sidewall structure 20.

The base 14 and launch tube 16 are of integral or integrated construction, and are preferably formed of high-density polyethylene. In one embodiment, the base 14 and the launch tube 16 are injection molded as a unitary piece. In other embodiments, the base 14 and the launch tube 16 are separately formed and then integrated together in various suitable processes. For example, a heat welding process may be used in which the portions of base 14 and launch tube 16 to be joined together are heated and brought into contact with each other. As another example, a frictional welding process may be used in which the tube 16 is rotated at high speed while pressed against the base 14. In a further example, a suitable adhesive may be used to join the base 14 with the launch tube 16.

The fireworks aerial shell 10 is designed to be loaded into the launch tube 16 of the fireworks launcher 12 through the open top 26 of the tubular wall 24. The fireworks aerial shell 10 is then lowered onto and rests on the closed bottom 28 of the tubular wall 24 before being launched out of the launch tube 16.

Figure 3:
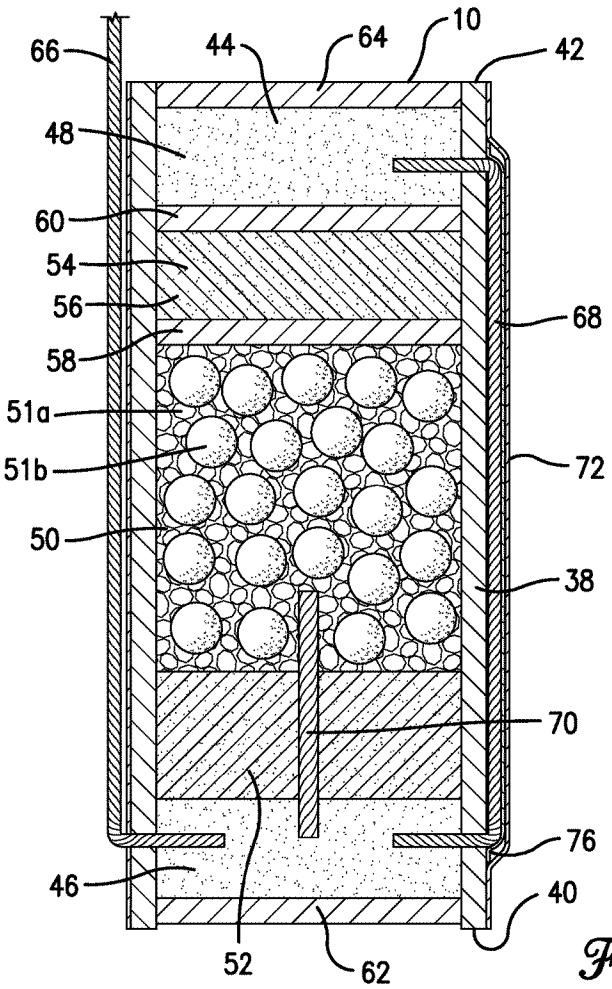
FIG. 3 is a side elevation view of the fireworks aerial display shell taken in vertical section to show details of construction.

As can best be seen in FIG. 3, the fireworks aerial display shell 10 comprises a normally cylindrical casing 38 having a first end 40 and an opposed second end 42. The casing 38 is sized so that its outer diameter is slightly smaller than the inner diameter of the launch tube 16. In one embodiment, the outer diameter of the casing 38 is 4-8 mm less than the inner diameter of the launch tube 16. As an example, the casing 38 may have an outside diameter of between 40 and 44 mm and an inside diameter of between 34 and 36 mm, and a longitudinal length of the between 90 and 110 mm. As another example, the casing 38 has an outer diameter of between 32 and 44 mm.

The casing 38 defines an interior volume 44 in which a first lift charge 46, a second lift charge 48, and an effects charge 50 are positioned. The first lift charge 46 is positioned in the interior volume 44 of the casing 38 at a location to cause a propelling force to be directed toward the first end 40 of the casing 38 after the first lift charge 46 is ignited. The second lift charge 48 is positioned in the interior volume 44 of the casing 38 at a location spaced apart from the first lift charge 44 to cause a propelling force to be directed toward the second end 42 of the casing 38 after the second lift charge 48 is ignited. In one embodiment, the first lift charge 46 is positioned at the first end 40 of the casing 38 and the second lift charge 48 is positioned at the second end 42 of the casing 38. The effects charge 50 is positioned in the interior volume 44 of the casing 38 between the first lift charge 46 and the second lift charge 48. In one embodiment, the effects charge 50 comprises a burst charge 51*a* and effects producing stars 51*b*.

The total quantity of pyrotechnics that may be used in the aerial display shell 10 may be limited by regulation. For example, the US Department of Transportation, as set forth in Title 49, Code of Federal Regulations, limits the total quantity of pyrotechnics to no more than 60 grams. Aerial display shells 10 made to comply with that regulation may, in one embodiment, include 5-10 grams of pyrotechnics in each of the first and second lift charges 46 and 48, 40-50 grams of pyrotechnics in the effects charge 50, and less than 1 gram of pyrotechnics in the fusing. The quantity of pyrotechnics in the first lift charge 46 may be the same or different than the quantity of pyrotechnics in the second lift charge 48. As one example, the first and second lift charges 46 and 48 may each have approximately 8 grams of pyrotechnics, the burst charge 51*a* may have 9 grams of pyrotechnics, and the effects producing stars 51*b* may have 35 grams of pyrotechnics. As another example, the first lift charge 46 may have approximately 5 grams of pyrotechnics, the second lift charge 48 may have approximately 8 grams of pyrotechnics, the burst charge 51*a* may have 9 grams of pyrotechnics, and the effects producing stars 51*b* may have 38 grams of pyrotechnics. The recited quantities of pyrotechnics may need to be slightly adjusted to account for the quantity of pyrotechnics contained in the fusing described below. Other quantities of pyrotechnics may, of course, be used.

The first and second lift charges 46 and 48 typically comprise granulated black powder, but other suitable materials may be used. As but one example, a composition by weight of about 74% potassium nitrate, 6% sulfur, and 20% carbon, such as charcoal, may be used. The composition of the first lift charge 46 may be the same as or different than the composition of the second lift charge 50. The burst charge 51*a* may comprise a composition by weight of 22% potassium perchlorate, 48% potassium nitrate, 26% carbon, typically charcoal, and 4% polished gelatinous rice powder. The effects producing stars 51*b* may be of a chrysanthemum type that creates a white or colored spherical break pattern with visible trails of sparks (coruscations), or they may be of a peony type that creates a white or colored spherical break pattern without visible trails of sparks. Of course, other types of effects may be produced and are within the scope of the invention. One composition by weight of the effects producing stars 51*b* comprises 40% potassium perchlorate, 25% strontium carbonate, 20% aluminum-magnesium, 10% phenolic resin, and 5% polyvinyl chloride.

The effects charge 50 is isolated from the first lift charge 46 by a first plug or partition 52 that extends across an inner cross section of the casing 38. The effects charge 50 is similarly isolated from the second lift charge 48 by a second plug or partition 54 that extends across the inner cross section of the casing 38. The first partition 52 comprises a layer of material that is incombustible during ignition of the first lift charge 46. In one embodiment, the material is a clay, such as in the form of a compacted clay powder. In other embodiments, the material may be a polymeric material, glue, paste, cement, calcite, or other materials.

The second partition 54 similarly comprises a layer of material 56, such as compacted clay powder, a polymeric material, glue, paste, cement or calcite, that is incombustible during ignition of the second lift charge 48. The second partition 54 may also include discs 58 and 60 that extend across the inner cross section of the casing 38 on opposite sides of the layer of material 56 such that the layer of material 56 is sandwiched between the discs 58 and 60. The discs 58 and 60 may be made of paper or other material to impede moisture intrusion into the second lift charge 48 and to facilitate formation of the layer of material 56. Similar discs may be used as part of the first partition 52. In one embodiment, an adhesive may be applied to the discs 58 and 60, such as along their outer perimeters, to securely retain the discs 58 and 60 in place during the ignition of the first lift charge 46 and the second lift charge 48.

The casing 38 of the fireworks aerial display shell 10 also includes a first retaining disc 62 that extends across the inner cross section of the casing 38 and is positioned against the first lift charge 46 on a side opposite the first partition 52 so that the first lift charge 46 is positioned between the first retaining disc 62 and the first partition 52. A second retaining disc 64 similarly extends across the inner cross section of the casing 38 and is positioned against the second lift charge 48 on a side opposite the second partition 54 so that the second lift charge 46 is positioned between the second retaining disc 62 and the second partition 54. The first and second retaining discs 62 and 64 may be made of paper or other material and may be respectively positioned at the first and second ends 40 and 42 of the casing 38. The first and second retaining discs 62 and 64 are intended to be ruptured or removed by the forces exerted upon ignition of the first and second lifting charges 46 and 48.

The aerial display shell 10 further includes fuses that are operatively associated with the first and second lift charges 46 and 48 and the effects charge 50 in a manner to ignite the first and second lift charges 46 and 48 and then ignite the effects charge 50 a period of time after the first and second lift charges 46 and 48 are ignited. As a result of this delayed ignition of the effects charge 50, whichever one of the first lift charge 46 or second lift charge 48 is positioned against the closed bottom 28 of the launch tube 16 is able to propel the aerial display shell 10 upwardly out of the launch tube 16 and to an intended elevation before the effects charge 50 is ignited to create the pyrotechnic visual effects display.

In one embodiment, the fuses that control the sequenced ignition of the first and second lift charges 46 and 48 and then the effects charge 50 comprise a lead fuse 66 that is operatively associated with the first lift charge 46 to cause ignition of the first lift charge 46 after lighting and burning of the lead fuse 66, a connection fuse 68 that operatively associates the first lift charge 46 with the second lift charge 48 to cause ignition of the second lift charge 48 as a result of ignition of the first lift charge 46, and a timing or delay fuse 70 that operatively associates the first lift charge 46 with the effects charge 50 to cause ignition of the effects charge 50 as a result of the burning of the first lift charge 46.

The lead fuse 66 has a length that is positioned external to casing 38 and an outer wrap 72 that surrounds the casing 38. Another length of the lead fuse 66 extends through the casing 38 and into the first lift charge 46. The lead fuse 66 is secured in a manner to impede its removal from within the first lift charge 46. The length of the lead fuse 66 that is external to the casing 38 is normally sufficient to allow its free end 74 (FIG. 1) to extend above the open top 26 of the tubular wall 24 of the launch tube 16 when the aerial display shell 10 is loaded in the fireworks launcher 12. In one embodiment, the length of the lead fuse 66 that is external to the casing 38 is at least twice a longitudinal length of the casing 38. In another embodiment, the external length of the lead fuse 66 is at least three times the longitudinal length of the casing 38.

Figure 4:
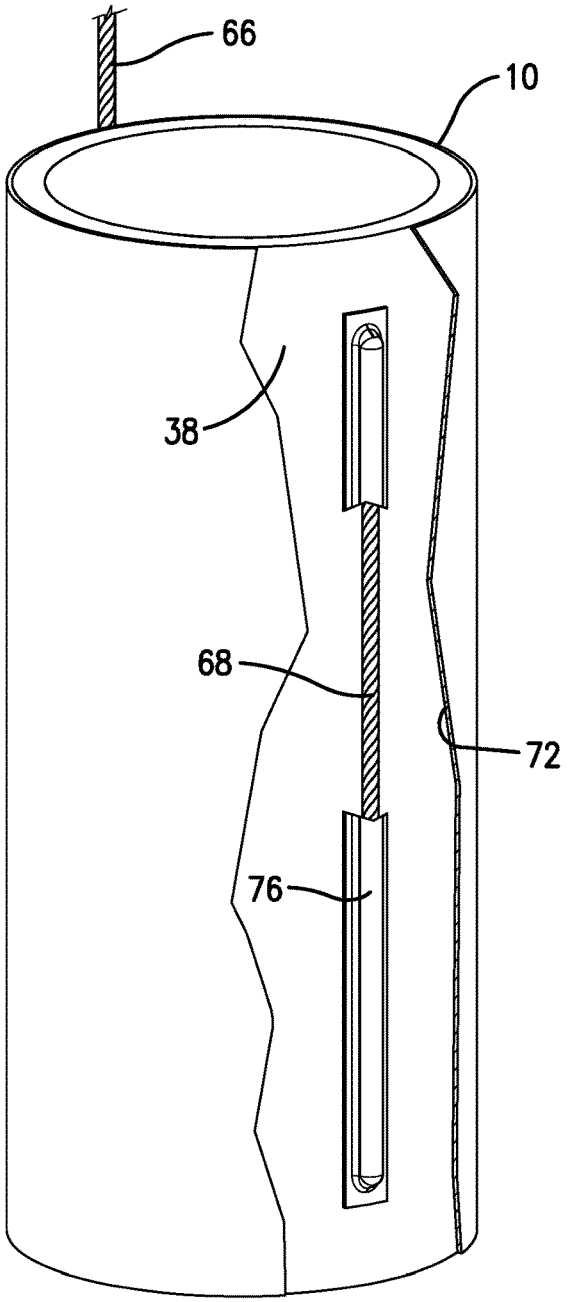
FIG. 4 is a side elevation view of the fireworks aerial display shell with an outer wrap removed and portions of a covering for a connection fuse broken away.

The connection fuse 68 has a length that is positioned external to the casing 38. The externally positioned length of the connection fuse 68 may be recessed within an external groove (not shown) in the casing 38 so that the presence of the connection fuse 68 does not cause the overall diameter of the aerial display shell 10 to exceed regulatory limits. One end of the connection fuse 68 extends through the casing 38 and into the first lift charge 46, while its opposite end extends through the casing 38 and into the second lift charge 48. The connection fuse 68 is isolated from the lead fuse 66 in a manner to impede the opportunity for burning of the lead fuse 66 to cause ignition of the connection fuse 68. In one embodiment, the connection fuse 68 is positioned between the casing 38 and the outer wrap 72 and may include an additional covering, such as a length of tape 76 as shown in FIG. 4, to shield the connection fuse 68 as well as to anchor it to the casing 38.

The timing or delay fuse 70 has one end positioned within the first lift charge 46 and a second end positioned within the effects charge 50. The delay fuse 70 is isolated from both the lead fuse 66 and the connection fuse 68 to impede the opportunity for burning of the lead fuse 66 or the connection fuse 68 to cause ignition of the delay fuse 70. In one embodiment, the delay fuse 70 is routed from the first lift charge 46 to the effects charge 50 through the first partition 52.

The burn rate and the length of the lead fuse 66 are selected so that a person may ignite the free end 74 of the lead fuse 66 and move away from the mortar 12 before the lead fuse 66 burns along its length to ignite the first lift charge 46. In one embodiment, the burn rate and length, or burn time, of the lead fuse 66 are selected so that a period of time of between 3 and 9 seconds elapses between igniting of the free end 74 of the lead fuse 66 and ignition of the first lift charge 46. In one embodiment, the burn rate and length of the connection fuse 68 are selected so that a period of time of less than one second elapses between the ignition of the connection fuse 68 by the ignited first lift charge 46 and igniting of the second lift charge 48 by the ignited connection fuse 68. In one embodiment, the burn rate and length of the timing or delay fuse 70 are selected so that a period of time of between 2 and 5 seconds elapses between the ignition of the timing fuse 70 by the burning first lift charge 46 and igniting of the effects charge 50 by the burning delay fuse 70.

In one exemplification of the fuses of the aerial display shell 10, the period of time between igniting the free end 74 of the lead fuse 66 and its igniting of the first lift charge 46 is approximately six seconds, the period of time between ignition of the connection fuse 68 by the burning first lift charge 46 and the igniting of the second lift charge 48 by the ignited connection fuse 68 is approximately 0.5 seconds, and the period of time between ignition of the delay fuse 70 by the burning first lift charge 46 and the ignition of the effects charge 50 is approximately 3 seconds. In this embodiment, when the aerial display shell 10 is loaded in the launch tube 16 with the first lift charge 46 facing the closed bottom 28 of the launch tube 16, the second lift charge 48 will not ignite until after the first lift charge 46 has propelled the aerial shell 10 upwardly from the launch tube 16 to a height well above the launch tube 16 and near the intended height at which the effects charge 50 is ignited. When the aerial display shell 10 is loaded in the launch tube 16 with the second lift charge 48 facing the closed bottom 28 of the launch tube 16, the second lift charge 48 ignites while the aerial shell 10 is still loaded in the launch tube 16 and is effective to launch the aerial display shell 10 upwardly from the launch tube 16 to a height below that reached when the aerial shell 10 is oriented with the first lift charge 46 facing the closed bottom 28 of the launch tube 16, but still high enough so that ignition of the effects charge 50 produces the pyrotechnic visual effects display safely above any spectators in the area.

In another exemplification of the fuses of the aerial display shell 10, the first and second lift charges 46 and 48 may be ignited simultaneously or within a time period that causes the second lift charge 48 to be ignited while the aerial display shell 10 remains in the launch tube 16 irrespective of whether the aerial shell is loaded so that the first lift charge 46 is facing the closed bottom 28 of the launch tube 16 or the second lift charge 48 is facing the closed bottom 28. In this embodiment, the connection fuse 68 may be omitted and the lead fuse 66 may operate to ignite both the first and second lift charges 46 and 48. Alternatively, the connection fuse 68 may be present, but is of a burn rate and length to ignite the second lift charge 48 while the aerial display shell 10 is still in the launch tube 16.

In other embodiments, the timing or delay fuse 70 may extend between the second lift charge 48 and the effects charge 50 rather than between the first lift charge 46 and the effects charge 50 or delay fuses 70 may extend between both the first and second lift charges 46 and 48 and the effects charge 50. Redundant fuses may also be included to ensure proper operation of the aerial display shell 10 in the event of a defect in one of the fuses.

The present invention is also directed to a method of launching the aerial display shell 10 from within the launch tube 16 and creating a pyrotechnic visual effects display at a height above the launch tube 16. The aerial display shell 10 is placed in the launch tube 16 with one of the first and second ends 40 or 42 of the cylindrical casing 38 facing the closed bottom 28 of the launch tube 16 and the other of the first and second ends 40 or 42 of the casing 38 facing the open top 26 of the launch tube 16. The free end 74 of the lead fuse 66 is then ignited and burns along its length to then cause ignition of the first lift charge 46, which causes a first propelling force to be directed toward the first end 40 of the cylindrical casing 38. The ignited first lift charge 46 then causes igniting of the second lift charge 48, such as by igniting the connection fuse 68 that extends between the first and second lift charges 46 and 48. The ignited second lift charge 48 causes a second propelling force to be directed toward the second end 42 of the cylindrical casing in a direction opposite to the first propelling force. When the aerial shell 10 is oriented in the launch tube 16 with the first end 40 of the cylindrical casing 38 facing the closed bottom 28 of the launch tube 16, the first propelling force launches the aerial display shell 10 out of the launch tube 16 and to a height above the launch tube 16. When the aerial display shell 10 is oriented in the launch tube 16 with the second end 42 of the cylindrical casing 38 facing the closed bottom 28 of the launch tube 16, the second propelling force launches the aerial display shell 10 out of the launch tube 16 and to the same or a different height that would have been reached if the first propelling force had launched the aerial display shell 10 above the launch tube 16. The effects charge 50 is then ignited, such as by ignition and burning of the timing or delay fuse 70 that extends between the first lift charge 46 and the effects charge 50, to create a pyrotechnic visual effects display a period of time after the launching of the aerial display shell 10 out of the launch tube 16 by the first or second propelling force. When the first propelling force launches the aerial display shell 10 out of the launch tube 16, the second lift charge 48 may be ignited while the aerial display shell 10 is still within the launch tube 16 or after the aerial shell 10 has reached a safe height above the launch tube 16.

The second lift charge 48 as used in the aerial display shell 10 is advantageous because it ensures that the effects charge 50 is not ignited within the launch tube 16 irrespective of whether the aerial display shell 10 is loaded into the launch tube 16 with the first lift charge 52 facing the closed bottom 28 or the open top 26 of the launch tube 16.

From the foregoing, it will be seen that this invention is one well adapted to attain all the ends and objectives hereinabove set forth together with other advantages that are inherent to the structure.

It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A fireworks aerial display shell comprising:

a cylindrical casing having first and second ends and defining an interior volume, said casing having an outer diameter of between 32 and 44 mm;

a first lift charge positioned in the interior volume of the casing at the first end of the casing;

a second lift charge positioned in the interior volume of the casing at the second end of the casing;

an effects charge positioned in the interior volume of the casing between the first lift charge and the second lift charge; and fuses operatively associated with the first and second lift charges and the effects charge in a manner to ignite the first and second lift charges less than one second apart and then igniting the effects charge a period of time after said igniting of the first and second lift charges, wherein the fuses include a lead fuse operatively connected to the first lift charge in a manner for causing ignition thereof as a result of burning of the lead fuse.

2. The fireworks aerial display shell of claim 1, wherein the period of time is between 2 and 5 seconds.

3. The fireworks aerial display shell of claim 1, wherein the fuses further include a connection fuse operatively connecting the first lift charge with the second lift charge in a manner to cause the second lift charge to be ignited as a result of ignition of the first lift charge, and a delay fuse operatively connecting the effects charge with either the first lift charge or the second lift charge to cause the effects charge to be ignited as a result of burning of the first lift charge or the second lift charge.

4. The fireworks aerial display shell of claim 3, including an outer wrap surrounding said casing, wherein said connection fuse is positioned between the outer wrap and the casing and said lead fuse extends outside said outer wrap.

5. The fireworks aerial display shell of claim 1, including a first partition extending across an inner cross section of the casing and positioned between the first lift charge and the effects charge and a second partition extending across the inner cross section of the casing and positioned between the second lift charge and the effects charge.

6. The fireworks aerial display shell of claim 5, wherein the first lift charge is positioned between the first partition and a first retaining disc extending across the inner cross section of the casing and the second lift charge is positioned between the second partition and a second retaining disc extending across the inner cross section of the casing.

7. The fireworks aerial display shell of claim 5, wherein said fuses include a delay fuse operatively connecting the effects charge with the first lift charge and extending through said first partition.

8. The fireworks aerial display shell of claim 7, wherein said first partition comprises a layer of compacted clay material.

9. The fireworks aerial display shell of claim 8, wherein the second partition comprises a layer of compacted clay material sandwiched between two discs.

10. The fireworks aerial display shell of claim 1, wherein the effects charge comprises a break charge and effects producing stars.

11. The fireworks aerial display shell of claim 1, wherein the effects charge produces upon ignition a spherical radial pattern of burning stars.

12. The fireworks aerial display shell of claim 1, wherein the casing comprises paper.

13. The fireworks aerial display shell of claim 1, wherein the first lift charge and the second lift charge comprise granulated black powder.

14. The fireworks aerial display shell of claim 1, wherein the first lift charge and the second lift charge each comprises 7 to 9 grams of black powder.

15. The fireworks aerial display shell of claim 1, wherein a total of less than 60 grams of pyrotechnics is present in the interior volume of the casing and the fuses.

16. The fireworks aerial display shell of claim 1, wherein the lead fuse is also operatively connected to the second lift charge in a manner for causing ignition thereof following lighting of the lead fuse and the fuses further include a delay fuse operatively connecting the effects charge with either the first lift charge or the second lift charge to cause the effects charge to be ignited as a result of ignition of the first lift charge or the second lift charge.

17. The fireworks aerial display shell of claim 1, wherein the casing has a longitudinal length of between 90 and 110 mm and an outside diameter of between 40 and 44 mm.

18. The fireworks aerial display shell of claim 17, wherein the casing has an inside diameter of between 34 and 36 mm.

19. A consumer fireworks aerial display shell for launching into the air from within a launch tube, said fireworks aerial display shell comprising:

a cylindrical casing having first and second ends and defining an interior volume;

a first lift charge comprising 5 to 10 grams of pyrotechnics positioned in the interior volume of the casing at the first end of the casing and operable to cause a propelling force to be directed toward the first end of the casing after the first lift charge is ignited;

a second lift charge comprising 5 to 10 grams of pyrotechnics positioned in the interior volume of the casing at the second end of the casing and operable to cause a propelling force to be directed toward the second end of the casing after the second lift charge is ignited;

an effects charge comprising 40 to 50 grams of pyrotechnics positioned in the interior volume of the casing between the first lift charge and the second lift charge;

a lead fuse operatively associated with the first lift charge and the second lift charge for causing ignition of the first lift charge and the second lift charge; and a delay fuse operatively associating the first lift charge with the effects charge for causing ignition of the effects charge at least 2 seconds after ignition of the first lift charge, wherein less than a total of 60 grams of pyrotechnics is present in the first and second lift charges, the effects charge, and the lead and delay fuses.

20. A consumer fireworks aerial display shell comprising:

a cylindrical casing having first and second ends and defining an interior volume, said cylindrical casing having a longitudinal length of between 90 and 110 mm and an outside diameter of between 40 and 44 mm;

a first lift charge comprising 7 to 9 grams of black powder positioned in the interior volume of the casing at the first end of the casing and operable to cause a propelling force to be directed toward the first end of the casing after the first lift charge is ignited;

a second lift charge comprising 7 to 9 grams of black powder positioned in the interior volume of the casing at the second end of the casing and operable to cause a propelling force to be directed toward the second end of the casing after the second lift charge is ignited;

an effects charge positioned in the interior volume of the casing between the first lift charge and the second lift charge and separated from the first lift charge by a first partition extending across an inner cross section of the casing and positioned between the first lift charge and the effects charge and separated from the second lift charge by a second partition extending across the inner cross section of the casing and positioned between the second lift charge and the effects charge;

a lead fuse operatively associated with the first lift charge for causing ignition of the first lift charge;

a connection fuse operatively associating the first lift charge with the second lift charge to cause the second lift charge to ignite less than one second after the first lift charge ignites; and a delay fuse operatively associating the effects charge with the first lift charge for causing a delayed ignition of the effects charge after ignition of the first lift charge or with the second lift charge for causing a delayed ignition of the effects charge after ignition of the second lift charge, wherein less than a total of 60 grams of pyrotechnics is present in the first and second lift charges, the effects charge, and the lead, connection and delay fuses.

* * * * *